US005711099A

United States Patent [19]

Nesbit et al.

[11] Patent Number: 5,711,099

[45] Date of Patent: Jan. 27, 1998

[54] SNOW GLOBE

[75] Inventors: Mark S. Nesbit, West Des Moines; Duane H. Swensen, Des Moines, both of Iowa

[73] Assignee: International Product Concepts, Inc., Pleasant Hill, Iowa

[21] Appl. No.: 634,563

[22] Filed: Apr. 18, 1996

[51] Int. Cl.[6] ..... G09F 19/00

[52] U.S. Cl. ..... 40/406; 40/410

[58] Field of Search ..... 40/406, 409, 410, 40/411, 414, 547; 446/267, 485; 239/18, 20

[56] References Cited

U.S. PATENT DOCUMENTS

| | | | |
|---|---|---|---|
| 3,535,805 | 10/1970 | Peiperl | 40/406 |
| 3,564,233 | 2/1971 | Cox et al. | 40/547 X |
| 4,490,931 | 1/1985 | Fleemin | 40/409 X |
| 4,641,445 | 2/1987 | Rossi | 40/410 |
| 4,817,311 | 4/1989 | Ong | 40/410 |
| 5,018,288 | 5/1991 | Yang | 40/406 |
| 5,131,175 | 7/1992 | Liu | 40/410 |
| 5,167,993 | 12/1992 | Aoyagi | 40/406 X |
| 5,277,644 | 1/1994 | Osborne et al. | 446/485 X |
| 5,313,727 | 5/1994 | Murray, Jr. | 40/410 |
| 5,416,994 | 5/1995 | McLaughlin | 40/406 |
| 5,442,869 | 8/1995 | McDarren et al. | 40/406 |

*Primary Examiner*—Brian K. Green

*Attorney, Agent, or Firm*—G. Brian Pingel; Brett J. Trout

[57] ABSTRACT

A decorative visual display device for circulating a fluid and simulated snow particles around a diorama. A snow globe is provided with a fluid propeller to circulate the fluid and particles within an outer transparent shell to provide the visual effect of snow falling on the diorama. A motor is placed within the base of the snow globe and may be actuated or deactuated to start and stop the snowfall effect.

18 Claims, 4 Drawing Sheets

SNOW GLOBE

BACKGROUND OF THE INVENTION

FIELD OF THE INVENTION

The present invention relates to a snow globe and, more particularly, to a snow globe with means for circulating the snow within the globe.

Snow globes are well-known in the art. Prior art snow globes typically consist of a clear glass or acrylic shell secured to a base of some kind. Provided within the shell is a clear fluid such as water. Provided within the shell is a winter display such as a small house, Christmas tree, etc. Small white particles of plastic or other material are also placed within the shell to give the appearance of snow. When the device is shaken the particles are distributed throughout the fluid and when the device is set down the particles slowly sink through the fluid to give the appearance of a winter snowfall.

One drawback of prior art snow globes is the necessity of constantly having to shake the globe manually to distribute the particles throughout the fluid. While particles having a specific gravity similar to that of the fluid may be used so that the particles remain evenly distributed throughout the fluid, the effect of a snowfall is substantially diminished if the particles are not constantly moving.

While it is known in the art to provide a motorized impeller to circulate particles throughout the fluid, these devices have several drawbacks. Because snow globes typically have a figurine or a diorama in the center of the globe, the prior art motorized impeller is placed to one side or the other of the diorama in a single chamber having an intake side and a discharge side in which the impeller is located. This placement of the impeller works well at circulating particles which fall into the impeller, but does not work well for particles falling on the opposite side of the diorama.

In prior art motorized devices the impeller operates at a slow speed to simulate snowfall. This slow rate of fluid circulation is insufficient to draw particles falling on the opposite side of the diorama into the impeller. Accordingly, particles accumulate on the side of the diorama opposite the impeller until there are no more particles circulating in the fluid. These prior art motorized snow globes must therefore be manually shaken after a period of time to redistributed the particles within the fluid.

What is desired is a snow globe which mechanically recirculates the particles without having to be manually shaken to redistribute the particles within the fluid. The difficulties encountered hereinabove are sought to be eliminated by the present invention.

SUMMARY OF THE INVENTION

The present invention comprises a decorative visual display device. The device has a shell constructed with sides of a fluid-tight material and is filled with a fluid. To allow viewing into the device, the shell and fluid are each constructed of material at least partially transparent to light. A plurality of particles which are at least partially opaque to light are provided in the fluid. Additionally, means are provided substantially equidistant from the sides of the shell and in operable communication with the fluid for moving the fluid within the shell.

In the preferred embodiment the device is provided with a display such as a house or Christmas tree to enhance the visual impact of the snowfall. Additionally, the fluid moving means is preferably a propeller and the device is fitted with baffles to direct the fluid into and away from the propeller. In an alternative embodiment of the invention a light source is provided as are means to transfer the light from the light source below the shell to one or more light emitters provided on the display.

DETAILED DESCRIPTION OF THE PREFERRED EMBODIMENT

Figure 1:
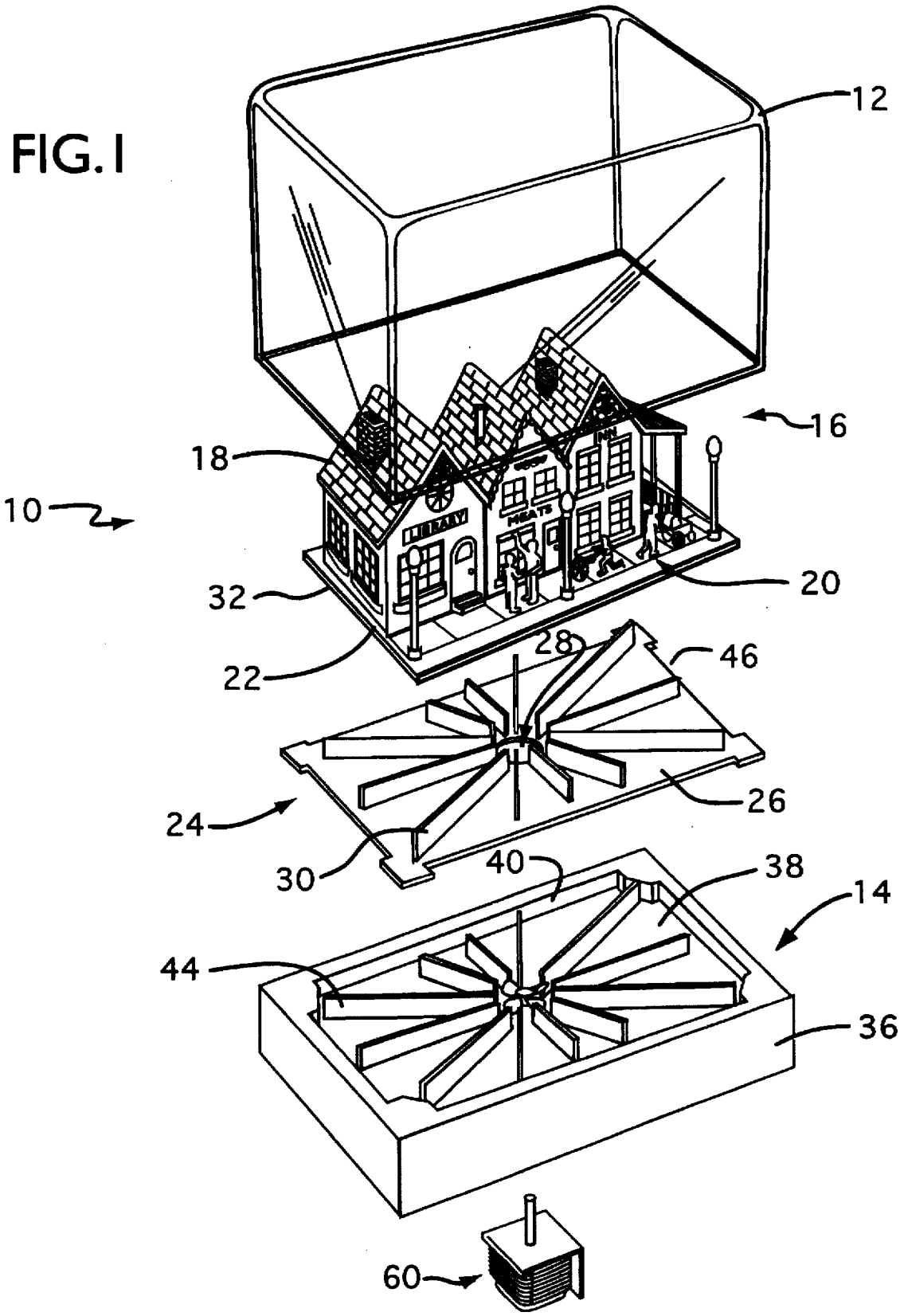
FIG. 1 is an exploded perspective view of the snow globe of the present invention shown without the fluid.

With reference to the drawings, shown in FIG. 1 is a snow globe 10. The snow globe 10 comprises a shell 12 secured to a base 14. While in the preferred embodiment, the shell 12 is constructed with sides of clear glass, the shell 12 may, of course, be constructed of any transparent or semi-transparent fluid-tight material. The base 14 is constructed of porcelain, but may be constructed of any fluid-tight material known in art.

As shown in FIG. 1, provided within the shell 12 is a diorama 16. While the diorama 16 of FIG. 1 shows a neighborhood scene with buildings 18 and people 20, the diorama may, of course, be constructed to depict any figure or scene. The diorama 16 is also provided with a base plate 22. Secured to the base plate 22 of the diorama 16 is an intake assembly 24. The intake assembly 24 is constructed of a flow separation plate 26 which is of a slightly larger area than the base plate 22 of the diorama 16. Provided in the middle of the flow separation plate 26 is an intake hole 28. Secured to the flow separation plate 26 and extending radially outward from the intake hole 28 are a plurality of intake baffles 30.

Figure 2:
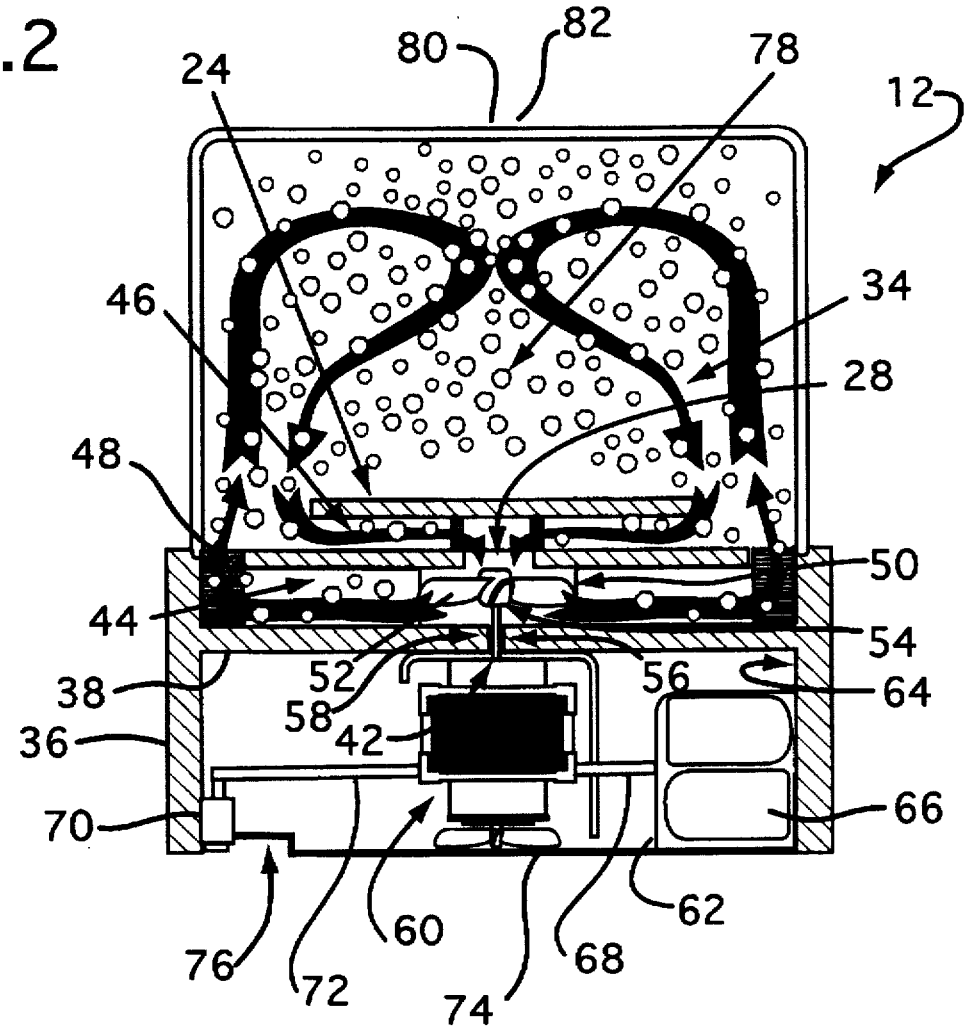
FIG. 2 is a side elevation in cross-section showing the snow globe of FIG. 1 with an illustration of the fluid flow patterns.

The intake baffles 30 and flow separation plate 26 are preferably molded of polyvinylchloride or similar plastic material. The intake baffles 30 radiate from the intake hole 28 outward a distance sufficient to meet the edges 32 of the base plate 22 of the diorama 16. The intake baffles 30 are one centimeter tall to allow sufficient room for the fluid 34 to flow between the base plate 22 and flow separation plate 26 into the intake hole 28 when the display is secured to the intake assembly 24 (FIG. 2). Although shown slightly darkened to aid in the description thereof, the shell 12 and fluid 34 are transparent in the preferred embodiment. The fluid 34 may be water, glycerine, saline or any clear fluid. Additionally, a preservative such as any of those well-known in the art may be added to the fluid 34.

As shown in FIG. 1, the base 14 is constructed of porcelain walls 36 surrounding and secured to a discharge plate 38. As shown in FIG. 1, the discharge plate 38 is set deep enough into the porcelain walls 36 so as to form a lip 40 which surrounds the discharge plate 38. As shown in FIG.

2, the discharge plate 38 is provided with a small hole 42. Secured to the discharge plate 38 and extending radially outward from the small hole 42 are a plurality of discharge baffles 44. As shown in FIG. 2, the discharge baffles 44 are slightly longer than the intake baffles 30 so as to meet the edges 46 of the intake assembly 24 when the intake assembly 24 is secured to the discharge plate 38. Additionally, the discharge baffles 44 are somewhat taller than the intake baffles 30 to provide a slightly larger space between the discharge plate 38 and intake assembly 24 than between the intake assembly 24 and diorama 16.

As shown in FIG. 2, when the intake assembly 24 is secured to the discharge plate 38 with glue or similar adhesive and the diorama 16 is secured to the intake assembly 24 with glue or similar adhesive, the intake baffles 30 create a plurality of separate intake ports 45 to form a fluid intake perimeter 46. Similarly the discharge baffles 44 create a plurality of discharge ports 47 to form a fluid discharge perimeter 48.

Centered over the small hole 42 of the discharge plate 38 is a fluid propeller 50. The fluid propeller 50 is constructed of four blades 52 angled to draw fluid 34 into the fluid intake perimeter 46 through the intake hole 28 and to propel the fluid 34 out through the fluid discharge perimeter 48. The blades 52 are secured to a hub 54 which, in turn, is connected to a drive shaft 56. The drive shaft 56 passes through the small hole 42 of the discharge plate 38. To prevent fluid 34 from escaping through the small hole 42, a gasket 58 is positioned in the small hole 42 between the drive shaft 56 and the discharge plate 38.

As shown in FIG. 2, the drive shaft 56 is connected to a rotational electric motor 60, which preferably does not extend below the porcelain walls 36. The placement of the electric motor 60 within the porcelain walls 36 prevents the snow globe 10 from tipping when placed on a level surface. Also positioned inside the porcelain walls 36 is a battery pack 62 constructed of plastic or similar material and secured to an interior surface 64 of the porcelain walls 36 by adhesive or similar securement means. Positioned within the battery pack 62 is a pair of C-cell batteries 66 coupled to the electric motor 60 by a first set of wires 68. An electric switch 70 is also coupled to the electric motor 60 by a second set of wires 72.

As shown in FIG. 2, a plastic plate 74 is secured to the bottom of the porcelain walls 36 with adhesive or similar connection means. The plastic plate 74 is molded to provide an indentation 76 into which the electric switch 70 extends so as to allow the electric switch 70 to be actuated without having to remove the plastic plate 74 from the porcelain walls 36. As shown in FIG. 2, provided in the fluid 34 are a plurality of particles 78. The particles 78 are preferably constructed of polyvinylchloride and molded in a spherical shape or other shape designed to simulate snow. It is most advantageous to construct the particles 78 of a material having a specific gravity only slightly heavier than that of the fluid 34. This allows the particles 78 to slowly descend through the fluid 34, thereby giving the appearance of snowfall.

To actuate the snow globe 10, the electric switch 70 is actuated to send power from the battery pack 62 to the electric motor 60. The electric motor 60 turns the drive shaft 56, which causes the fluid propeller 50 to turn. As the fluid propeller 50 turns, fluid is drawn through the fluid intake perimeter 46, between the intake baffles 30 and down through the intake hole 28. After the fluid 34 and particles 78 have been drawn through the intake hole 28, the fluid 34 and particles 78 are driven outward through the discharge baffles 44 and out of the fluid discharge perimeter 48. From the fluid discharge perimeter 48, the fluid 34 and particles 78 rise, driven by the fluid propeller 50 to the top 80 of the shell 12. As the fluid 34 and particles 78 contact the top 80 of the shell, the fluid 34 and particles 78 curve toward the center 82 of the top 80 of the shell 12 where the fluid 34 and particles 78 begin to descend onto the diorama 16. As the fluid 34 and particles 78 descend, they give the appearance of snowfall upon the buildings 18 and people 20. The fluid 34 and particles 78 continue to fall until they are again drawn into the fluid intake perimeter 46 and the process is repeated.

The size of the fluid propeller 50 and electric motor 60 may be adjusted along with the fluid 34 type and particle 78 size to custom tailor the snowfall effect desired. It is desirable, however to center the fluid propeller 50 within the snow globe 10, or at least to center the fluid intake perimeter 46 so that particles 78 do not build up along any portion of the snow globe 10. It is also desirable to provide intake baffles 30 around at least one hundred and eighty degrees of the fluid propeller 50 for the same reason.

When it is desired to stop the snowfall, the electric switch 70 is used to deactuate the electric motor 60 which, in turn, stops the fluid propeller 50. When the fluid propeller 50 stops, the particles 78 are no longer being recirculated after falling onto the diorama 16 or intake assembly 24.

Figure 3:
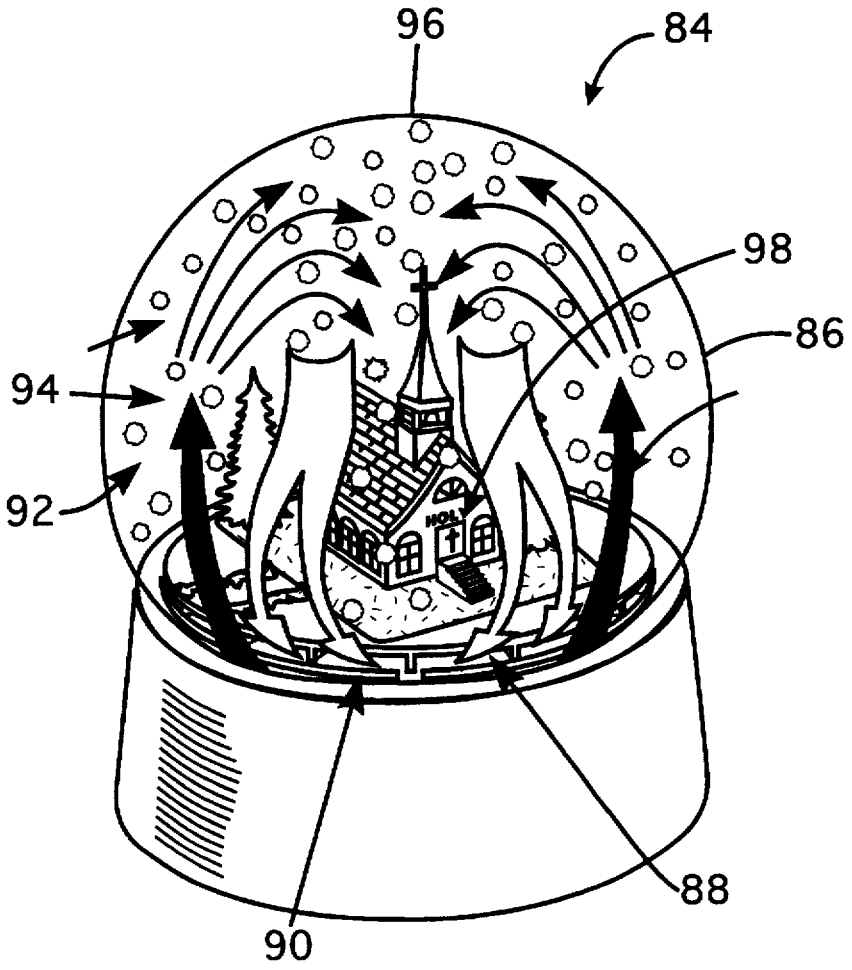
FIG. 3 is a perspective view of an alternative embodiment of the present invention showing fluid flow patterns in a round snow globe.

FIG. 3 shows an alternative snow globe 84 having a round shell 86. The alternative snow globe 84 has a circular fluid intake perimeter 88 and a circular fluid discharge perimeter 90 compared to the rectangular fluid intake perimeter 46 and rectangular fluid discharge perimeter 48 described above in the preferred embodiment. Otherwise, the alternative snow globe 84 works in a similar manner, with the fluid 92 and particles 94 being driven to the top 96 of the shell 86. Thereafter, the fluid 92 and particles 94 descend onto a FIG. 98 positioned within the alternative snow globe 84 to give the appearance of snowfall.

Figure 4A:
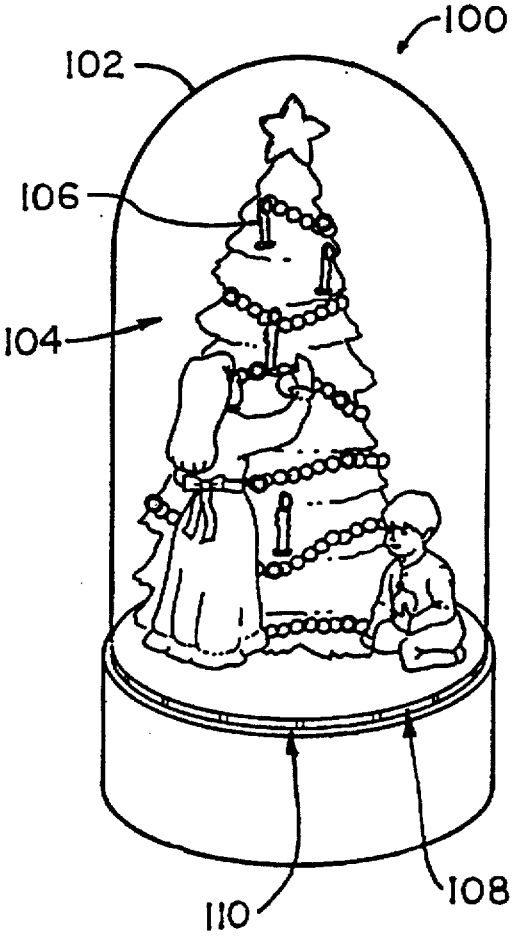
FIG. 4*a* is a side elevation of a second alternative embodiment of the present invention having a dome shaped shell and a lighted display.
Figure 4B:
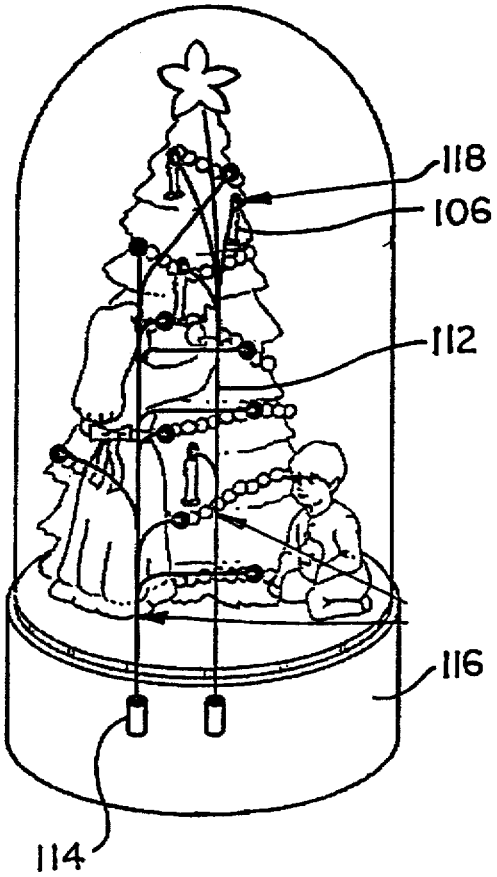
FIG. 4*b* is a side elevation in partial cross-section showing the lighting mechanism of the snow globe of FIG. 4*a*.

Shown in FIGS. 4*a* and 4*b* is another alternative snow globe 100 in which the shell 102 is in the shape of a dome. The FIG. 104 is in the shape of Christmas tree and provided with a plurality of simulated candles 106. As in the preferred embodiment, the alternative snow globe 100 is also provided with an intake perimeter 108 and a discharge perimeter 110 as described above.

As shown in FIG. 4*b*, the candles 106 are connected by fiber optic lines 112 to a light source 114 such as a battery operated incandescent light. The light source 114 is provided in the base 116 of the alternative snow globe 106. Simulated flames 118 of the candles 106 may be simply the ends of the fiber optic lines 112, or may be the ends of the fiber optic lines coated with a colored material to give the appearance of fire.

Although the invention has been described with respect to a preferred embodiment thereof, it is to be understood that it is not to be so limited, since changes and modifications can be made therein which are within the full intended scope of this invention as defined by the appended claims. For example, it is anticipated that various styles of shells, various types of fluid pumps and various types of fluid and particles may be used to provide different visual effects. It is additionally anticipated that any number or type of light sources may be used to provide different visual effects.

What is claimed is:

1. A decorative visual display device comprising:

(a) a shell having sides of a fluid-tight material, said shell being at least partially transparent to light;

(b) a fluid provided within said shell, said fluid being at least partially transparent to light;

(c) a plurality of particles provided in said fluid, wherein particles of said plurality of particles are constructed of a material which is visible when said particles are placed within said fluid;

(d) means positioned substantially equidistant from said sides of said shell and in operable communication with said fluid for moving said fluid for within said shell, wherein said moving means is a fluid propeller; and (e) means positioned in said fluid for creating a plurality of intake ports, wherein said plurality of intake ports are in fluid communication with an intake hole.

2. The decorative visual display device of claim 1, further comprising a base secured to said shell.

3. The decorative visual display device of claim 2, further comprising a diorama provided within said shell and operably secured over said base.

4. The decorative visual display device of claim 1, further comprising means in operable communication with said fluid for directing said fluid away from said moving means.

5. The decorative visual display device of claim 1, further comprising:

(a) a diorama;

(b) a light emitter coupled to said diorama;

(c) a light source; and (d) means for transferring light from said light source to said light emitter.

6. The decorative visual display device of claim 5, further comprising:

(a) a second light emitter coupled to said diorama; and (b) second means for transferring light from said light source to said second light emitter.

7. A decorative visual display device comprising:

(a) a shell having sides of a fluid-tight material, said shell being at least partially transparent to light;

(b) a fluid provided within said shell, said fluid being at least partially transparent to light;

(c) a plurality of particles provided in said fluid, wherein particles of said plurality of particles are constructed of a material which is visible when said particles are placed within said fluid;

(d) means positioned substantially equidistant from said sides of said shell and in operable communication with said fluid for moving said fluid within said shell, wherein said moving means comprises;

(i) a motor;

(ii) a propeller;

(iii) a drive shaft coupling said motor to said propeller; and (iv) means provided around said drive shaft for preventing escape of fluid from said shell; and e) means positioned in said fluid for creating a plurality of intake ports, wherein said plurality of intake ports are in fluid communication with an intake hole.

8. A decorative visual display device comprising:

(a) a shell having sides of a fluid-tight material, said shell being at least partially transparent to light;

(b) a fluid provided within said shell, said fluid being at least partially transparent to light;

(c) a plurality of particles provided in said fluid, wherein particles of said plurality of particles are constructed of a material which is visible when said particles are placed within said fluid;

(d) means positioned substantially equidistant from said sides of said shell and in operable communication with said fluid for moving said fluid within said shell;

(e) means positioned in said fluid for creating a plurality of intake ports, wherein said plurality of intake ports are in fluid communication with an intake hole; and (f) a plurality of discharge baffles extending radially from said moving means.

9. The decorative visual display device of claim 8, further comprising a plurality of intake baffles extending radially from said intake hole, wherein said means for creating a plurality of intake ports and said plurality of intake baffles are positioned over said plurality of discharge baffles.

10. The decorative visual display device of claim 9, further comprising a diorama secured over said intake assembly.

11. A decorative visual display device comprising:

(a) a shell constructed of a fluid-tight material;

(b) a fluid provided within said shell;

(c) a plurality of particles provided within said shell, said plurality of particles being free to move relative to said shell;

(d) means for moving said fluid within said shell, wherein said moving means is a fluid propeller;

(e) means positioned in said fluid for creating a plurality of intake ports, wherein said plurality of intake ports are in fluid communication with an intake hole; and (f) means for directing said fluid away from said moving means.

12. The decorative visual display device of claim 11, further comprising a base secured to said shell.

13. The decorative visual display of claim 12, further comprising a diorama provided within said shell and operably secured to said base.

14. The decorative visual display device of claim 11, further comprising:

(a) a diorama;

(b) a light emitter coupled to said diorama;

(c) a light source; and (d) means for transferring light from said light source to said light emitter.

15. A decorative visual display device comprising:

(a) a shell constructed of a fluid-tight material;

(b) a fluid provided within said shell;

(c) a plurality of particles provided within said shell, said plurality of particles being free to move relative to said shell;

(d) means for moving said fluid within said shell, wherein said moving means comprises:

(i) a motor;

(ii) a propeller;

(iii) a drive shaft coupling said motor to said propeller; and (iv) means provided around said drive shaft for preventing escape of fluid from said shell;

(e) means positioned in said fluid for creating a plurality of intake ports, wherein said plurality of intake ports are in fluid communication with an intake hole; and (f) means for directing said fluid away from said moving means.

16. A decorative visual display device comprising:

(a) a shell constructed of a fluid-tight material;

(b) a fluid provided within said shell;

(c) a plurality of particles provided within said shell, said plurality of particles being free to move relative to said shell;

(d) means for moving said fluid within said shell;

(e) means positioned in said fluid for creating a plurality of intake ports, wherein said plurality of intake ports are in fluid communication with an intake hole; and (f) means for directing said fluid away from said moving means, wherein said means for directing said fluid away from said moving means comprises a plurality of discharge baffles extending radially from said moving means.

17. The decorative visual display device of claim 16, further comprising a plurality of intake baffles extending radially from said intake hole, wherein said means for creating a plurality of intake ports and said plurality of intake baffles are positioned over said plurality of discharge baffles.

18. A decorative visual display device comprising:

(a) a shell having sides of a fluid tight material, said shell being at least partially transparent to light;

(b) a fluid provided within said shell, said fluid being at least partially transparent to light;

(c) a plurality of particles provided in said fluid, wherein particles of said plurality of particles are constructed of a material which is visible when said particles are placed within said fluid;

(d) means in operable communication with said fluid for moving said fluid within said shell;

(e) a first plate having a face, wherein said face of said first plate is in contact with said fluid;

(f) a second plate having a face, wherein said face of said second plate is in contact with said fluid, and wherein said face of said second plate is facing said face of said first plate; and (g) a plurality of baffles provided within said fluid, and extending radially outward, wherein said baffles are positioned between said face of said first plate and said face of said second plate.

* * * * *